US005817450A

United States Patent [19]

Kawanishi et al.

[11] Patent Number: 5,817,450

[45] Date of Patent: Oct. 6, 1998

[54] EMULSIFICATION AND DISPERSION METHOD OF HYDROPHOBIC, PHOTOGRAPHICALLY USEFUL COMPOUND

[75] Inventors: Naoyuki Kawanishi; Masataka Ogawa; Atsushi Hayakawa; Kazuhiko Fujiwara, all of Kanagawa, Japan

[73] Assignee: Fuji Photo Film Co., Ltd., Kanagawa, Japan

[21] Appl. No.: 603,916

[22] Filed: Feb. 22, 1996

[30] Foreign Application Priority Data

Feb. 24, 1995 [JP] Japan ..... 7-060081

[51] Int. Cl.[6] ..... G03C 5/38; G03C 7/388; G03C 11/22; G03C 1/38

[52] U.S. Cl. ..... 430/455; 430/449; 430/461; 430/546; 430/564; 430/566; 430/631; 430/628; 106/135; 252/312; 252/364

[58] Field of Search ..... 430/546, 631, 430/449, 564, 566, 628, 455, 461; 106/135; 252/312, 364

[56] References Cited

U.S. PATENT DOCUMENTS

| | | | |
|---|---|---|---|
| 2,870,012 | 1/1959 | Godowsky et al. | 96/97 |
| 4,211,836 | 7/1980 | Yoneyama et al. | 430/449 |
| 4,378,425 | 3/1983 | Schnoring et al. | 430/546 |
| 5,200,303 | 4/1993 | Takahashi et al. | 430/377 |
| 5,426,019 | 6/1995 | Chari | 430/546 |

FOREIGN PATENT DOCUMENTS

| | | | |
|---|---|---|---|
| 0361322 | 4/1990 | European Pat. Off. | G03C 1/005 |
| A-0361924 | 4/1990 | European Pat. Off. | G03C 7/34 |
| A-0555923 | 8/1993 | European Pat. Off. | G03C 7/388 |
| 1193349 | 5/1970 | United Kingdom | G03C 7/34 |
| 1560378 | 2/1980 | United Kingdom | G03C 1/06 |

OTHER PUBLICATIONS

Research Disclosure No. 16468, Dec. 1977, Webb, "Process for preparing . . . materials".

*Primary Examiner*—Richard L. Schilling
*Attorney, Agent, or Firm*—Sughrue, Mion, Zinn, Macpeak & Seas, PLLC

[57] ABSTRACT

An emulsification and dispersion method of a hydrophobic, photographically useful compound comprising dispersing a water-insoluble phase containing the hydrophobic, photographically useful compound in water or in a hydrophilic colloid composition, wherein the water-insoluble phase at a temperature at which the prepared dispersion is stored may have a viscosity of from 100 poise or more to less than 1,000,000 poise at the shear rate of 10 $sec^{-1}$. According to the present invention, a silver halide photographic material comprising a fine dispersion of a hydrophobic, photographically useful compound and having an excellent production suitability can be obtained.

6 Claims, No Drawings

EMULSIFICATION AND DISPERSION METHOD OF HYDROPHOBIC, PHOTOGRAPHICALLY USEFUL COMPOUND

FIELD OF THE INVENTION

The present invention relates to a method for dispersing a photographically useful compound used in a silver halide photographic material. More specifically, it relates to a method for stably emulsification dispersing a hydrophobic, photographically useful compound in water or in a hydrophilic colloid composition.

BACKGROUND OF THE INVENTION

A photographic material comprises on a support at least one hydrophilic colloid layer containing a hydrophobic, photographically useful compound.

The hydrophobic, photographically useful compound includes, for example, coupler for forming image, colored coupler, development inhibitor-releasing coupler, discoloration inhibitor, antifoggant, ultraviolet absorbent, photographic dye and color mixing inhibitor. In general, the hydrophobic, photographically useful compound is incorporated into a photographic material by a method called as the oil-protect method where the compound is dissolved in a high boiling point organic solvent, which is then emulsified and dispersed, a method where the compound is directly dispersed in the solid state without using any organic solvent, or a method where a hydrophobic, photographically useful compound is dissolved in an organic solvent miscible with water or in a basic aqueous solution and then precipitated and dispersed in water as fine particles as described in British Patent 1,193,343; RD No.16468; U.S. Pat. No. 2,870,012; and European Patent Nos. 361,322 and 347,837.

In any of the above-described methods, the photographically useful compound must be dispersed as fine particles in a size less than 1 $\mu$m to increase the surface area per unit weight of dispersoid so that the expensive photographic compound can be effectively used. However, it cannot evade the general fate of colloid dispersions such that the aging stability of dispersion is worsened as the particle number and the interfacial area increases, which gives rise to deterioration not only in quality in view of photographic performance but also in coating quality due to comet accompanying generation of coarse grains or crystallization of hydrophobic compound.

These problematic phenomena are particularly outstanding during storage of the above-described dispersions and when gelatin is contained therein, they must be caused during either storage at a temperature lower than the gelation temperature of the aqueous gelatin solution or storage at a temperature higher than the melting point of the gel. Accordingly, the aging time under control may be restricted or in some cases, an uneconomical situation is brought about such that the dispersion containing defects has to be discarded.

The object of the present invention is to solve the above-described problems encountered in conventional techniques and to provide an emulsification method capable of obtaining a dispersion free from particle growth during aged storage or generation of coarse particles or precipitated crystals with keeping fine particle performance at the time of dispersion.

As the result of intensive investigations, the present inventors have found that the above-described object can be achieved by:

(1) a method for emulsification and dispersing a water-insoluble phase containing a hydrophobic, photographically useful compound in water or in a hydrophilic colloid composition, wherein the water-insoluble phase is prepared and used so that the water-insoluble phase prepared at a temperature at which the prepared dispersion is stored may have a viscosity of from 100 poise to 1,000,000 poise at the shear rate of 10 $sec^{-1}$;

(2) a method for emulsification and dispersing a water-insoluble phase containing a hydrophobic, photographically useful compound in water or in a hydrophilic colloid composition, wherein the water-insoluble phase is prepared and used by adding a thickener to a water-insoluble phase so that the water-insoluble phase at a temperature at which the prepared dispersion is stored may have a viscosity of from 100 poise to 1,000,000 poise at the shear rate of 10 $sec^{-1}$; and (3) a method for emulsification and dispersing a water-insoluble phase containing a hydrophobic, photographically useful compound and an organic solvent having a low boiling point in water or in a hydrophilic colloid composition, wherein the water-insoluble phase is prepared and used by eliminating the low boiling point organic solvent during dispersing or after dispersing in water or in the hydrophilic colloid composition so that the water-insoluble phase at a temperature at which the prepared dispersion is stored may have a viscosity of from 100 poise to 1,000,000 poise at the shear rate of 10 $sec^{-1}$.

DETAILED DESCRIPTION OF THE INVENTION

The present invention will be described below in detail.

The present invention is effective in dispersing a hydrophobic, photographically useful compound (hereinafter, sometimes referred to as a "hydrophobic compound" or a "photographic compound") as fine particles at a high concentration. More specifically, the effect of the present invention is conspicuous in obtaining dispersions having an average particle size of less than 1 $\mu$m and a dispersoid volume ratio of 10% or more. Generally, the emulsified dispersion of the present invention is obtained by dissolving a hydrophobic compound by separately using a high boiling point organic solvent having a boiling point of about 175° C. or more and/or a low boiling point organic solvent having a boiling point of about from 30° C. to about 150° C., or by using an optional mixture thereof, followed by dispersing the resulting solution in water or in a hydrophilic colloid composition. In the course of the preparation of such emulsified dispersion as well as in the course of storing the prepared emulsified dispersion, however, it is often experienced that a hydrophobic compound is crystallized from a water-insoluble phase to be grown into coarse particles. As the reason, it can be generally mentioned that a hydrophobic, photographically useful compound such as an image-forming coupler has a large molecular weight of 500 or more and also has an extremely complicated molecular structure so that the compound is hardly present as a stable dissolution state in an organic solvent. Further, it is also caused by the fact that recently, for achieving image qualities such as sharpness and graininess required for photographic material, a photographic compound is required to be incorporated into a photographic material film at a high density, and, therefore, the concentration of the photographic compound inside a particle in an emulsified dispersion is often set at the saturated solubility or more. If the emulsified dispersion having such conditions is stored, the crystallization of the photographic compound inside each dispersed particle proceeds so that the entire dispersion finally can be converted to a precipitated state. If a photographic emulsion containing this emulsified dispersion is coated, defects such as comet frequently occur to deteriorate the value as commercial products.

We have analyzed in detail the deposition mechanism of an emulsified product wherein a water-insoluble phase having a composition which may readily cause crystallization is dispersed. As the result, it could be found that the viscosity of the water-insoluble phase greatly affects the deposition. That is, even in a situation wherein supersaturating degree is high so that a crystal nucleus is readily generated, if the viscosity of the water-insoluble phase is sufficiently high, the movement of dissolved molecules is restricted, which may result in the retardation in a crystal growth rate. When the water-insoluble phase has a sufficiently high viscosity, a noticeable crystal growth does not occur during usual storage of an emulsified dispersion. Thus, the deterioration in the coating quality substantially can be avoided. At a composition comprising various photographic compounds and an organic solvent, for maintaining a storage term of about three months, it is demonstrated that a viscosity of a water-insoluble phase has to be at least 100 poise or more at the shear rate of 10 $sec^{-1}$.

In order to realize this viscosity region of a water-insoluble phase, three methods can be mentioned: a first method wherein in addition to a photographically useful compound, a high boiling point organic solvent and a low boiling point organic solvent, which generally constitute a water-insoluble phase, a polymer such as a synthetic polymer is added as a thickener to increase an apparent viscosity; a second method wherein the concentration of a dissolved compound in a water-insoluble phase is increased by removing a low-boiling point organic solvent during dispersion or after dispersion of the compound thereby to increase the viscosity of the water-insoluble phase, although an initial water-insoluble phase includes a large amount of the low-boiling point organic solvent so that it has a low viscosity; and a third method wherein when a photographic compound has a melting point of less than 100° C., it is emulsified and dispersed around the melting point thereof, thereafter the formed emulsion is cooled to a temperature of 5° C. to 60° C., preferably 5° C. to 40° C., which are usual storing temperatures thereby to increase the viscosity of the water-insoluble phase. According to our investigations, in the utilization of any of the above-described methods, if a water-insoluble phase at a storing temperature has a viscosity of 100 poise or more at the shear rate of 10 $sec^{-1}$, the formation of any deposited matter which may deteriorate a coating quality during three month storage was not observed. In the third method wherein the emulsification is effected at a temperature around a melting point, however, a melting point is determined by a photographic compound itself. Thus, this method cannot be used in various fields as compared with other two methods.

A viscosity of a water-insoluble phase in the present invention can be measured according to any methods as long as they are viscosity determination methods capable of defining a shear rate such as a capillary type, a double cylinder type, etc. Especially, a cone plate E model viscometer, however, is desirable in the point that it can conveniently and accurately evaluate a viscosity of from 1 to 100,000 poise at the shear rate of 10 $sec^{-1}$. Further, the viscosity of a water-insoluble phase becomes impossible to be determined after an emulsification dispersion process because the water-insoluble phase is divided into fine particles. Therefore, it is required to determine the viscosity of the water-insoluble phase prior to effecting an emulsification dispersion process and to arrange the formulation thereof so as to obtain the viscosity of the present invention.

The higher the viscosity of a water-insoluble phase at the shear rate of 10 $sec^{-1}$ is, the slower the molecules of a photographic compound moves. Accordingly, the effect for preventing crystallization becomes high. However, when the water-insoluble phase is made have an extremely high viscosity, i.e., almost solid state, practically various problems may arise. For example, in the first method in accordance with the present invention wherein a thickener is added, when the viscosity of a water-insoluble phase becomes too high, emulsification-dispersibility is deteriorated so that fine particles can not be obtained. Further in the second method in accordance with the present invention wherein a low-boiling point organic solvent is removed, when a photographic compound exhibits its functions in a photographic material with accompanying a chemical reaction as in an image-forming coupler and an antifoggant, may arise a problem wherein a photographic activity lowers with increase in the viscosity of a water-insoluble phase.

In view of the above-description, the viscosity of a water-insoluble phase at the shear rate of 10 $sec^{-1}$ has an upper limit. That is, the viscosity in accordance with the present invention should be within a range of from 100 poise or more and less than 1,000,000 poise, preferably from 100 poise or more and less than 100,000 poise, and more preferably from 1,000 poise or more and less than 100,000 poise.

A thickener of a water-insoluble phase used in the present invention may be any polymers as long as they comprise at least one repeating unit and are water-insoluble and an organic solvent-soluble. As the repeating unit forming these polymers, mention may be made of acrylic esters, methacrylic esters, vinyl esters, acrylamides, methacrylamides, olefins, and vinyl ethers.

The polymer in the present invention may be a homopolymer having single kind of repeating unit or a copolymer or block copolymer constituted by two or more kinds of repeating units.

The higher the molecular weight or the polymerization degree of a polymer is, the more the thickening action enhanced. Therefore, even if a small amount of such polymer is added to a water-insoluble phase, a desired viscosity can be preferably obtained, but the solubility of the polymer in a water-insoluble phase decreases, so the amount of the polymer to be added must be set at an appropriate value depending upon a kind of a polymer. It is important that the glass transition temperature of a polymer is a storage temperature or more of an emulsified dispersion for keeping a viscosity inside a water-insoluble phase constant as a thickener. It is desired that the glass transition temperature of the polymer is preferably 40° C. or more, more preferably 60° C. or more.

Specific examples of the thickeners used in the present invention are partially described below, but the present invention is by no means limited thereto.

| | |
|---|---|
| (P-1) | poly (2-tert-butylphenyl acrylate) |
| (P-2) | poly (4-tert-butylphenyl acrylate) |
| (P-3) | polymethyl methacrylate |
| (P-4) | polyethyl methacrylate |
| (P-5) | polymethyl chloroacrylate |
| (P-6) | poly (N-sec-butylacrylamide) |

-continued

| | |
|---|---|
| (P-7) | poly (N-tert-butylacrylamide) |
| (P-8) | poly (N-tert-butylmethacrylamide) |
| (P-9) | poly (4-biphenyl acrylate) |
| (P-10) | poly (2-chlorophenyl acrylate) |
| (P-11) | poly (4-cyanobenzyl acrylate) |
| (P-12) | poly (3-methoxycarbonylphenyl acrylate) |
| (P-13) | polyvinyl-tert-butyrate |
| (P-14) | poly (ethylfluoromethacrylate) |
| (P-15) | methylmethacrylate/vinyl chloride copolymer (70:30) |
| (P-16) | methylmethacrylate/styrene copolymer (90:10) |
| (P-17) | vinyl chloride/vinyl acetate copolymer (65:35) |
| (P-18) | methylmethacrylate/phenylvinylketone copolymer (70:30) |
| (P-19) | methylmethacrylate/acrylic acid copolymer (95:5) |
| (P-20) | methylmethacrylate/acrylonitrile copolymer (70:30) |
| (P-21) | methylmethacrylate/styrene/vinylphosphonamide copolymer (70:20:10) |
| (P-22) | n-butylmethacrylate/methylmethacrylate/benzyl methacrylate/acrylic acid copolymer (35:35:25:5) |
| (P-23) | n-butylmethacrylate/methylmethacrylate/acrylamide copolymer (35:35:30) |
| (P-24) | n-butylmethacrylate/methylmethacrylate/vinyl chloride copolymer (37:36:27) |

A low boiling point organic solvent can be eliminated according to a known method. For example, as described in each specification of U.S. Pat. Nos. 2,322,027; 2,801,171; 2,949,360; and 3,396,027, in a case of an emulsified dispersion using an aqueous hydrophilic colloidal solution having a gelation temperature such as gelatin, the dispersion is extruded in the form of noodle at a temperature of the gelation temperature or less, followed by rinsing with water, whereby a low-boiling point organic solvent can be removed. Further, as the method for removing a low-boiling point organic solvent, mention may be made of a method using an ultrafiltration film as described in JP-A-60-158437 and a method using a dialysis membrane as described in U.S. Pat. Nos. 5,024,929 and 5,108,611. Still further, as described in JP-B-61-56010, can be employed a method wherein a low-boiling point organic solvent is evaporated by a vacuum process or a heating process thereby to eliminate the same.

Among these methods, in a method comprising a combination of a vacuum process and a heating process, various molecular distillation and evaporation units described in "Kagaku Kogaku Binran (Chemical Engineering Handbook)" edited by Chemical Engineering Association (Maruzen Co. Ltd.) can be used alone or in any combinations thereof. In any methods, however, an evaporation rate is determined depending upon a temperature of a heated emulsified dispersion and a vacuum degree and an elimination ratio of a low-boiling point organic solvent varies depending upon an operation time. In the elimination of a low-boiling point organic solvent, when an emulsified dispersion has a too high temperature or an operation time is long, the dispersion may cause a thermal deterioration to be grown into coarse particles or a photographic compound may be decomposed. Thus, the caution should be taken so as not to cause such problems. Accordingly, it is desired that an emulsified dispersion is stored at a temperature of less than 60° C., preferably less than 50° C. An operation time under this temperature condition is preferably less than 60 minutes, more preferably less than 30 minutes.

In order to realize a high viscosity region of a water-insoluble phase in these ranges of the temperature and the operation time, which is the object of the present invention, a vacuum condition is required to be set at least less than 80%, preferably less than 50% and more preferably less than 30% of a vapor pressure of a low-boiling point organic solvent at a temperature of a heated emulsified dispersion, although the vacuum condition may vary depending upon the composition of the water-insoluble phase.

The hydrophobic, photographically useful compound usable in the present invention means any organic and inorganic compounds useful in photography. The hydrophobic, photographically useful compound content of the water-insoluble phase of this invention is from 10 to 90% by weight, preferably from 50 to 80% by weight. In the present invention, it is preferable to use an oil-soluble organic photographic material. The term "oil-soluble material" as used herein means those soluble in an organic solvent in an amount of 3% by weight or more at room temperature (20° C.). The organic solvent means those described in "Yozai (Solvent) Hand Book" and examples thereof include methanol, ethanol, isopropanol, butanol, ethyl acetate, butyl acetate, acetone, methyl ethyl ketone, tetrahydrofuran, cyclohexanone, benzene, toluene, dioxane, acetonitrile, dichloromethane, chloroform.

The hydrophobic, photographically useful compound usable in the dispersion of the present invention include a dye image-forming coupler, a dye image-providing redox compound, a stain inhibitor, an antifoggant, an ultraviolet light absorber, a discoloration inhibitor, a color mixing inhibitor, a nucleating agent, a dye image stabilizer, a silver halide solvent, a bleaching accelerator, a dye for filter or a precursor thereof, a dyestuff, a pigment, a sensitizer, a hardening agent, a brightener, a desensitizer, a developing agent, an antistatic agent, an antioxidant, a developer scavenger, a mordant, and an oil or polymer for dispersion used as a medium for dispersing these compounds and examples of the compounds include those described in *Research Disclosure* Nos.17643; 18716; and 307105.

The disperser used for practicing the present invention includes a high speed agitation-type disperser having a large shearing force and a disperser which provides highly intensified ultrasonic energy. Specifically, colloid mills, homogenizers, capillary type emulsifiers, liquid sirens, electromagnetic strain type ultrasonic generators and emulsifiers with Pullman's whistles may be used. The high speed agitation-type disperser used in the present invention is preferably a disperser of which main part to effect dispersion operation is rotated at a high speed in the solution ( at from 500 to 15,000 rpm, preferably 2,000 to 4,000 rpm), such as a dissolver, POLYTRON, homomixer, homoblender, Keddy mill or jet agitator. The high speed agitation-type disperser for use in the present invention is called as a dissolver or a high speed impeller dispersion machine. As described in JP-A-55-129136, is preferable a high speed impeller disperser and in one more preferable embodiment, an impeller comprising saw tooth blades folded alternately upward and downward is installed to the shaft which rotates at a high speed as described in JP-A-55-129136.

In the preparation of an emulsified dispersion comprising a hydrophobic compound according to the present invention, various processes can be employed. When the hydrophobic compound is dissolved in an organic solvent, it is dissolved in a single solvent or a mixed solvent comprising plurality of ingredients, freely selected from high boiling point organic materials, water-immiscible low-boiling point organic solvents and water-miscible organic solvents, which will be described below, followed by dispersing in water or in an aqueous hydrophilic colloid solution in the presence of a surfactant. A water-insoluble phase comprising a hydrophobic compound and an aqueous phase may be mixed by so-called a forward mixing method wherein a water-insoluble phase is added to an aqueous phase while stirring or by a reverse mixing method reversal thereto, but they are particularly preferably mixed by a phase inversion method as one of reverse mixing methods so as to provide a finer aqueous dispersion.

In the present invention, a hydrophobic compound can be dispersed in either water or a hydrophilic colloid composition, but is preferably dispersed in a hydrophilic colloid composition.

As the hydrophilic colloid used in the present invention, can be employed a binder or a protective colloid commonly used for silver halide photographic material. Gelatin is advantageously used as the binder or protective colloid, but other hydrophilic colloids also can be used. Examples thereof include gelatin derivatives, graft polymers of gelatin with other polymers, proteins such as albumin and casein; cellulose derivatives such as hydroxy cellulose, carboxymethyl cellulose and cellulose phosphoric esters; saccharide derivatives such as sodium alginate and starch derivatives; and various kinds of synthetic hydrophilic polymer materials, namely, homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

The examples of the high-boiling point solvents used in an oil-in water dispersion method are described in U.S. Pat. No. 2,322,027 and International Patent WO91/17480, and specific examples of the high boiling point organic solvent include phthalic esters, phosphoric or phosphonic esters, benzoic esters, amides, alcohols or phenols, aliphatic carboxylic esters, aniline derivatives, and hydrocarbons.

EXAMPLES

The present invention is described in detail by way of, but by no means limited to, the following Examples.

EXAMPLE 1

Emulsified products A-1 to A-8 were prepared by using the following Solutions I-1 and II-1 to II-8 according to the method described below.

| | |
|---|---|
| Solution I-1 | |
| Lime-processed gelatin solution (10%) | 1000 g |
| Solution II-1 | |
| Coupler (Y-1) shown below | 100 g |
| Tricresyl phosphate | 50 g |
| Ethyl acetate | 50 g |
| Sodium dodecylbenzenesulfonate | 10 g |
| Solution II-2 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 70,000) | 5 g |
| Solution II-3 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 70,000) | 10 g |

-continued

| | |
|---|---|
| Solution II-4 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 70,000) | 25 g |
| Solution II-5 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 70,000) | 40 g |
| Solution II-6 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 100,000) | 30 g |
| Solution II-7 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 60,000) | 30 g |
| Solution II-8 | |
| Coupler (Y-1) shown below | 100 g |
| Tricresyl phosphate | 50 g |
| Ethyl acetate | 50 g |
| Sodium dodecylbenzenesulfonate | 10 g |
| P-1 (Mw = 70,000) | 30 g |

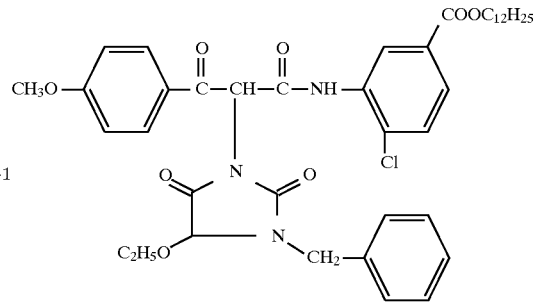

Y-1

Emulsification was conducted in such a way that Solution I and Solution II were dissolved at 60° C. and mixed, and then stirred in a 2 liter container using a dissolver blade having a diameter of 5 cm at a rotation speed of 5,000 rpm for 20 to 30 minutes so as to give an average particle size of about 0.15 μm. The average particle size was determined by means of NICOMP Model 370 manufactured by Nozaki Sangyo K. K. using dynamic light scattering.

Each of eight kinds of emulsified products prepared above was cooled to cause gelation and stored at 5° C. for a long period. Then the crystallization degrees of the couplers were determined. The determination of the viscosity of the Solution II was conducted in a constant temperature room at 5° C. using a E model viscometer manufactured by Tokyo Keiki K. K. The crystallization degrees of the couplers were determined by sampling 100 g of each emulsified product dissolved at 40° C., then effecting suction filtration of the samples by means of an EPOCEL filter having the nominal pore diameter of 3 μm manufactured by PALL Corporation, successively determining the weights of the residue remained on the filter, which were then compared to each other.

The results are shown in Table 1. In A-1 wherein no polymer is added, A-2 and A-3 wherein an addition amount of a polymer is small and the viscosity is less than 100 poise, which are comparative examples, the crystallization of a coupler can be noticeably observed. Contrary to this, in the emulsified products A-4 to A-8 according to the present invention, only a slight crystallization occurs even for a long term storage. Thus, an excellent stability of emulsified products of the present invention can be demonstrated.

TABLE 1

| Emulsified Product No. | Viscosity of Solution II at 5° C. (poise) | Residual weight (g) after filtration of emulsified product 100 g: Immediately after preparation | 10 days at 5° C. | 30 days at 5° C. | 60 days at 5° C. | 90 days at 5° C. |
|---|---|---|---|---|---|---|
| A-1 (Comparison) | 7 | 0.0 | 0.4 | 1.7 | can't be filtrated | can't be filtrated |
| A-2 (Comparison) | 15 | 0.0 | 0.3 | 0.9 | 1.8 | can't be filtrated |
| A-3 (Comparison) | 65 | 0.0 | 0.0 | 0.1 | 0.5 | 1.6 |
| A-4 (Invention) | 115 | 0.0 | 0.0 | 0.0 | 0.2 | 0.3 |
| A-5 (Invention) | 180 | 0.0 | 0.0 | 0.0 | 0.0 | 0.1 |
| A-6 (Invention) | 155 | 0.0 | 0.0 | 0.0 | 0.1 | 0.1 |
| A-7 (Invention) | 240 | 0.0 | 0.0 | 0.0 | 0.0 | 0.0 |
| A-8 (Invention) | 114 | 0.0 | 0.0 | 0.0 | 0.2 | 0.4 |

EXAMPLE 2

Emulsified product A-9 was prepared by using the above-described Solutions I-1 and the below-described Solution II-9 according to the method described below.

| Solution II-9 | |
|---|---|
| Coupler (Y-1) shown above | 100 g |
| Tricresyl phosphate | 100 g |
| sodium dodecylbenzenesulfonate | 10 g |

Emulsification was conducted in such a way that Solution I and Solution II were dissolved at 60° C. and 80° C., respectively and mixed, and then stirred in a 2 liter container lagged with 70° C. hot water jacket by using a dissolver blade having a diameter of 5 cm at a rotation speed of 6,000 rpm for 40 minutes so as to give an average particle size of about 0.15 μm.

The determination of the average particle size and the viscosity of Solution II as well as the evaluation of the crystallization of the coupler were effected in the same manner as in Example 1.

The results compared with the emulsified product A-1 of Example 1 are shown in Table 2. Although the melting point of the coupler-Y-1 is around 90° C., it remains a stable solution even at 70° C. in the presence of tricresyl phosphate (high boiling point solvent). Even by increasing the agitation speed as compared with the case of the emulsified product of Example 1, an extra time of 10 minutes or more was taken for reaching a desired average particle size. This is estimated owing to the decrease in the dispersion function due to an extremely high viscosity of Solution II-9. The viscosity is less than 1 poise at 70° C., but increases to five thousand times or more at 5° C. Accordingly, it can be clearly shown by Table 2 that regarding the crystallization, the coupler is extremely stable because the viscosity at 5° C. is far over 100 poise.

TABLE 2

| Emulsified Product No. | Viscosity of Solution II at 5° C. (poise) | Residual weight (g) after filtration of emulsified product 100 g: Immediately after preparation | 10 days at 5° C. | 30 days at 5° C. | 60 days at 5° C. | 90 days at 5° C. |
|---|---|---|---|---|---|---|
| A-1 (Comparison) | 7 | 0.0 | 0.4 | 1.7 | can't be filtrated | can't be filtrated |
| A-9 (Invention) | 5400 | 0.0 | 0.0 | 0.0 | 0.0 | 0.1 |

EXAMPLE 3

Emulsified product was prepared by using the below-described Solutions I-2 and Solution II-10 according to the method described below.

Solution I-2

| | |
|---|---|
| Lime-processed gelatin solution (12%) | 6000 g |

Solution II-10

| | |
|---|---|
| Coupler (C-1) shown below | 600 g |
| Tricresyl phosphate | 300 g |
| Ethyl acetate | 300 g |
| Sodium dodecylbenzenesulfonate | 60 g |

C-1

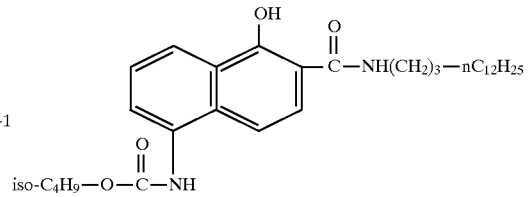

Emulsification was conducted in such a way that Solution I and Solution II were dissolved at 60° C. and mixed, and then stirred in a 10 liter container using a dissolver blade having a diameter of 7 cm at a rotation speed of 4,000 rpm for 20 to 30 minutes so as to give an average particle size of about 0.2 μm. Thereafter, the formed emulsion was taken in the amount of 1000 g per each and ethyl acetate was eliminated therefrom by means of a rotary evaporator at 50° C. under a reduced pressure of 50 to 400 torr, whereby B-2 to B-6 emulsified products were finally obtained.

The vapor pressure of ethyl acetate at 50° C. is about 300 torr. In B-2 and B-3 wherein the degree of reduced pressure was set at 400 torr and 300 torr, respectively, an adequate solvent removal could not be effected. While, in B-5 and B-6 wherein the pressure is reduced to less than one third of the vapor pressure of ethyl acetate, a residual solvent ratio was 10% or less.

The determination of an average particle size and a viscosity of Solution II as well as the evaluation of the crystallization of coupler were effected as in Example 1. The concentration of ethyl acetate was determined by means of a gas chromatography calibrated with an aqueous sample.

The results are shown in Table 3. With increase in the removal ratio of the solvent, the viscosity of Solution II increases, which can be seen in B-1 to B-6. At the same time, the crystallization degree of couplers decreases. In B-5 wherein the viscosity exceeds 100 poise, the generation of comet which may cause coating defects was not observed even after a long-term refrigeration of 90 days. Thus, it can be demonstrated that the utilization of the second method of the present invention wherein a low-boiling point organic solvent in an emulsified product is removed and the viscosity of a water insoluble phase is increased can provide excellent stability with time.

TABLE 3

| Emulsified Product No. | Remaining ethyl acetate (%*) | Viscosity of Solution II at 5° C. (poise) | Residual weight (g) after filtration of emulsified product 100 g: Immediately after preparation | 10 days at 5° C. | 30 days at 5° C. | 60 days at 5° C. | 90 days at 5° C. |
|---|---|---|---|---|---|---|---|
| B-1 (Comparison) | 100 | 0.7 | 0.0 | 2.1 | can't be filtrated | can't be filtrated | can't be filtrated |
| B-2 (Comparison) | 68 | 1.3 | 0.0 | 0.6 | 1.9 | can't be filtrated | can't be filtrated |
| B-3 (Comparison) | 51 | 11 | 0.0 | 0.3 | 1.8 | can't be filtrated | can't be filtrated |
| B-4 (Comparison) | 27 | 51 | 0.0 | 0.0 | 0.0 | 1.6 | can't be filtrated |
| B-5 (Invention) | 10 | 720 | 0.0 | 0.0 | 0.0 | 0.1 | 0.2 |
| B-6 (Invention) | 4 | 4600 | 0.0 | 0.0 | 0.0 | 0.0 | 0.1 |

*The proportion is based on the initial amount of ethyl acetate added.

As described in detail by way of Example, in accordance with the present invention, dispersed particles of a hydrophobic, photographically useful compound can be stably obtained, a long shelf stability with time is provided, and an excellent production suitability is provided. Further, in accordance with the present invention, a method for prevention of crystallization of a hydrophobic, photographically useful compound can be provided. Thus, the molecular designing of these compounds can be much freely conducted, which is, in turn, advantageous in photographic performance and an economical aspect.

While the invention has been described in detail and with reference to specific embodiments thereof, it will be apparent to one skilled in the art that various changes and modifications can be made therein without departing from the spirit and scope thereof.

What is claimed is:

1. A method for emulsification and dispersion of a water-insoluble phase consisting essentially of a hydrophobic, photographically useful compound having a melting point less than 100° C. and a high boiling point organic solvent in water or in a hydrophilic colloid composition, comprising dispersing the water-insoluble phase in water or in the hydrophilic colloid composition at a temperature around the melting point of the hydrophobic, photographically useful compound to prepare a dispersion, cooling the dispersion to a temperature of 5°–60° C., and then storing the dispersion, wherein the water-insoluble phase is prepared and used so that the water-insoluble phase at a temperature at which the prepared dispersion is stored has a viscosity of from 100 poise to 1,000,000 poise at the shear rate of 10 $sec^{-1}$.

2. The method for emulsification and dispersion as claimed in claim 1, wherein the water-insoluble phase consists of the hydrophobic, photographically useful compound having a melting point less than 100° C. and the high boiling point organic solvent.

3. The method for emulsification and dispersion as claimed in claim 1, wherein the hydrophobic, photographically useful compound is a dye image-providing redox compound, a stain inhibitor, an antifoggant, an ultraviolet light absorber, a discoloration inhibitor, a color mixing inhibitor, a nucleating agent, a dye image stabilizer, a silver halide solvent, a bleaching accelerator, a filter dye or precursor thereof, a dyestuff, a pigment, a sensitizer, a hardening agent, a brightener, a desensitizer, a developing agent, an antistatic agent, an antioxidant, a developer scavenger, a mordant, or an oil or polymer for dispersion.

4. The method for emulsification and dispersion as claimed in claim 2, wherein the hydrophobic, photographically useful compound is a dye image-providing redox compound, a stain inhibitor, an antifoggant, an ultraviolet light absorber, a discoloration inhibitor, a color mixing inhibitor, a nucleating agent, a dye image stabilizer, a silver halide solvent, a bleaching accelerator, a filter dye or precursor thereof, a dyestuff, a pigment, a sensitizer, a hardening agent, a brightener, a desensitizer, a developing agent, an antistatic agent, an antioxidant, a developer scavenger, a mordant, or an oil or polymer for dispersion.

5. The method for emulsification and dispersion as claimed in claim 1, wherein the cooling is to a temperature of 5°–40° C.

6. The method for emulsification and dispersion as claimed in claim 2, wherein the cooling is to a temperature of 5°–40° C.

* * * * *